US007969361B2

(12) United States Patent
Castaneda et al.

(10) Patent No.: US 7,969,361 B2
(45) Date of Patent: Jun. 28, 2011

(54) PLANAR INVERTED-F ANTENNA

(75) Inventors: Jesus Alfonso Castaneda, Los Angeles, CA (US); Seow-Eng McIlroy, Westchester, CA (US)

(73) Assignee: Broadcom Corporation, Irvine, CA (US)

( * ) Notice: Subject to any disclaimer, the term of this patent is extended or adjusted under 35 U.S.C. 154(b) by 862 days.

(21) Appl. No.: 11/679,659

(22) Filed: Feb. 27, 2007

(65) Prior Publication Data

US 2008/0001824 A1 Jan. 3, 2008

Related U.S. Application Data

(60) Provisional application No. 60/781,739, filed on Mar. 14, 2006.

(51) Int. Cl.
*H01Q 1/24* (2006.01)

(52) U.S. Cl. ..... 343/700 MS; 343/745

(58) Field of Classification Search ..... 343/700 MS, 343/702, 860, 745
See application file for complete search history.

(56) References Cited

U.S. PATENT DOCUMENTS 6,326,921 B1 12/2001 Egorov et al.
6,448,932 B1 9/2002 Stoiljkovic et al.
6,650,298 B2 * 11/2003 Abbasi et al. ..... 343/702
7,183,985 B2 * 2/2007 Tseng ..... 343/702
2003/0052827 A1 * 3/2003 Umehara et al. ..... 343/700 MS
2006/0066490 A1 * 3/2006 Ku et al. ..... 343/702

FOREIGN PATENT DOCUMENTS

EP 1 294 049 A1 3/2003
EP 1 418 644 A1 5/2004
EP 1 507 314 A1 2/2005
EP 1 750 325 A1 2/2007

OTHER PUBLICATIONS

Search Report from European Patent Appl. No. 07004699.0, 5 pages, dated Jun. 25, 2007.

* cited by examiner

*Primary Examiner* — Douglas W Owens
*Assistant Examiner* — Dieu Hien T Duong
(74) *Attorney, Agent, or Firm* — Sterne, Kessler, Goldstein & Fox P.L.L.C.

(57) ABSTRACT

A low profile Planar Inverted-F Antenna (PIFA) comprises a radiating strip, an inductive tuning portion, a vertical feed portion, and a retracted ground plane. The radiating strip is approximately parallel to the ground plane and is suspended above the ground plane by the feed element at a certain distance. Further, the radiating strip, in part or entirely, overhangs the ground plane. In this way, the radiating strip may be suspended very close to the ground plane, but yet exhibits a large bandwidth.

24 Claims, 10 Drawing Sheets

PLANAR INVERTED-F ANTENNA

CROSS REFERENCE TO RELATED APPLICATIONS

This application claims the benefit of U.S. Provisional Application No. 60/781,739 filed Mar. 14, 2006, which is incorporated herein by reference in its entirety.

FIELD OF THE INVENTION

The present invention relates generally to antennas and more specifically to a Planar Inverted F-Antenna.

BACKGROUND OF THE INVENTION

Planar inverted F-antenna (PIFA) has many advantages. It is easily fabricated, simple by design, and cost little to manufacture. Today, the PIFA is widely used in small communication devices such as personal digital assistants and mobile phones. Its popularity is due to its compact size that makes it easy to integrate into a device's housing, yielding a concealed antenna. PIFA also offers an additional advantage over monopole or whip antenna in terms of radiation exposure. For example, in a mobile phone, a whip antenna has an omnidirectional radiation field, whereas a PIFA has a relatively small radiation field toward the user. Thus making the PIFA more favorable for the health conscious consumers.

FIG. 1 illustrates a conventional PIFA 100. PIFA 100 consists of a ground plane 105, a radiating element 110, a feed element 115, and a shorting or tuning element 120. PIFA 100 is generally produced on a printed circuit board with ground plane 105 formed thereon. Feed element 115 supplies radio frequency (RF) signals to radiating element 110 which is held substantially parallel to ground plane 105 at a certain distance 125. The operating frequency or the resonance frequency of the PIFA may be controlled by controlling the size (width or length) of shorting element 120 and the dimensional ratio of radiating element 110. However, these frequency tuning techniques are less desirable because it may require the relocation of the shorting pin and the redesign of the IC board (not shown).

Impedance bandwidth is another important factor one must consider when designing a PIFA. Generally, a PIFA's bandwidth may be controlled by capacitive or dielectric loading means such as adding a parasitic shorted patch. The added parasitic shorted patch helps increase the impedance bandwidth because it introduces an additional resonant mode to the PIFA's resonance frequency band, thus creating dual-resonance band PIFA. However, these techniques increase the size and complexity of the antenna which lead to higher cost. In general, the most frequently used technique for increasing a PIFA's impedance bandwidth is to increase the height between radiating element 100 and ground plane 105, such as height 125 in PIFA 100. However, this technique is subjected to the size constraint of the antenna package; thus making it very difficult to increase the PIFA's bandwidth without increasing the PIFA's footprint.

Accordingly, what is needed is a PIFA where both the resonance frequency and the impedance bandwidth can be controlled and improved without increasing the size of the PIFA and its manufacturing cost.

BRIEF DESCRIPTION OF THE DRAWINGS/FIGURES

The present invention is described with reference to the accompanying drawings.

Figure 1:
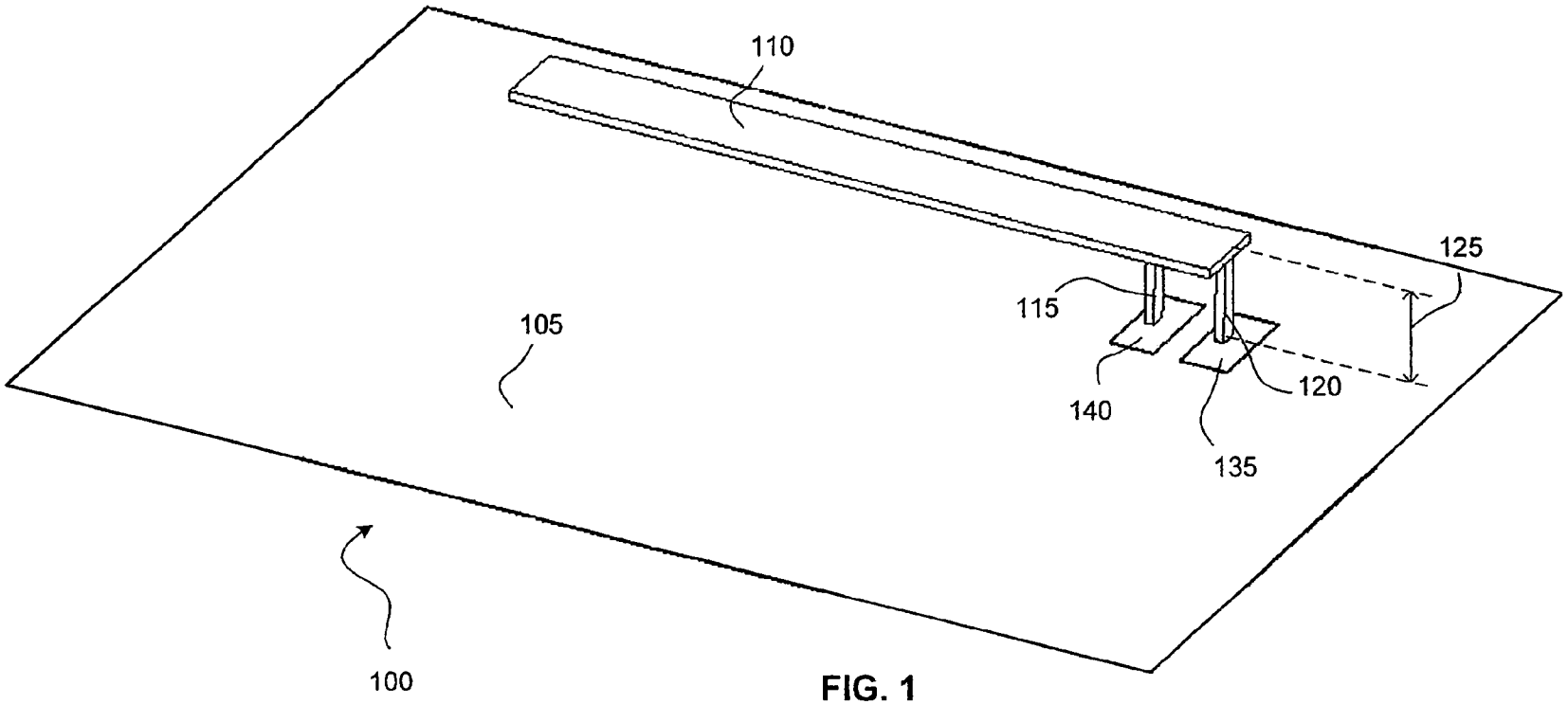
FIG. 1 (PRIOR ART)
FIG. 1 illustrates a conventional PIFA.

The present invention will now be described with reference to the accompanying drawings. In the drawings, like reference numbers generally indicate identical, functionally similar, and/or structurally similar elements. The drawing in which an element first appears is indicated by the leftmost digit(s) in the reference number.

DETAILED DESCRIPTION OF THE INVENTION

This specification discloses one or more embodiments that incorporate the features of this invention. The embodiment(s) described, and references in the specification to "one embodiment," "an embodiment," "an example embodiment," etc., indicate that the embodiment(s) described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is understood that it is within the knowledge of one skilled in the art to effect such feature, structure, or characteristic in connection with other embodiments whether or not explicitly described. An embodiment of the present invention is now described. While specific methods and configurations are discussed, it should be understood that this is done for illustration purposes only. A person skilled in the art will recognize that other configurations and procedures may be used without departing from the spirit and scope of the invention.

Generally, a PIFA such as PIFA 100 has the ability to send and receive electromagnetic signals in both vertical and horizontal polarized fields. For this reason, PIFA usage in mobile phones has been very popular. On a high level, PIFA 100 sends and receives electromagnetic radiation by taking advantage of its natural resonance frequency. PIFA's 100 resonance frequency can be modified by adjusting the dimension and shape of radiating element 110 or by moving the location of feed element 115 with respect to tuning element 120. Further, the resonance frequency of PIFA 100 can also be slightly adjusted by modifying the width and height of shorting or tuning element 120.

As shown in FIG. 1, PIFA 100 resonance or operating frequency is fixed by the shape, location, and size of radiating element 110, feed element 115, and tuning element 120, respectively. To this end, the FR4 substrate or the circuit board (not shown) in which PIFA 100 is formed thereon must be specifically designed for PIFA 100. For example, a hole must be formed in the circuit board underneath ground plane 105 at a certain location where feed element 115 is to be connected to a coaxial feed line (not shown). Similarly, the location of landing areas 135 and 140 must be taken into account when designing and fabricating the circuit board. Thus, from a manufacturing and designing perspective, it is impractical and expensive to re-tune PIFA 100 to a resonance frequency that is outside of its original design. Further, to improve the impedance bandwidth of PIFA 100, height 125 must be made larger. However, an increase in height 125 leads to an undesirable size increase of the overall antenna package size.

The present invention incorporates a PIFA design where the impedance bandwidth can be improved without increasing the size of the antenna package. Additionally, the frequency tuning process can be easily done without the need to relocate the feed location and/or redesign the circuit board.

Figure 2:
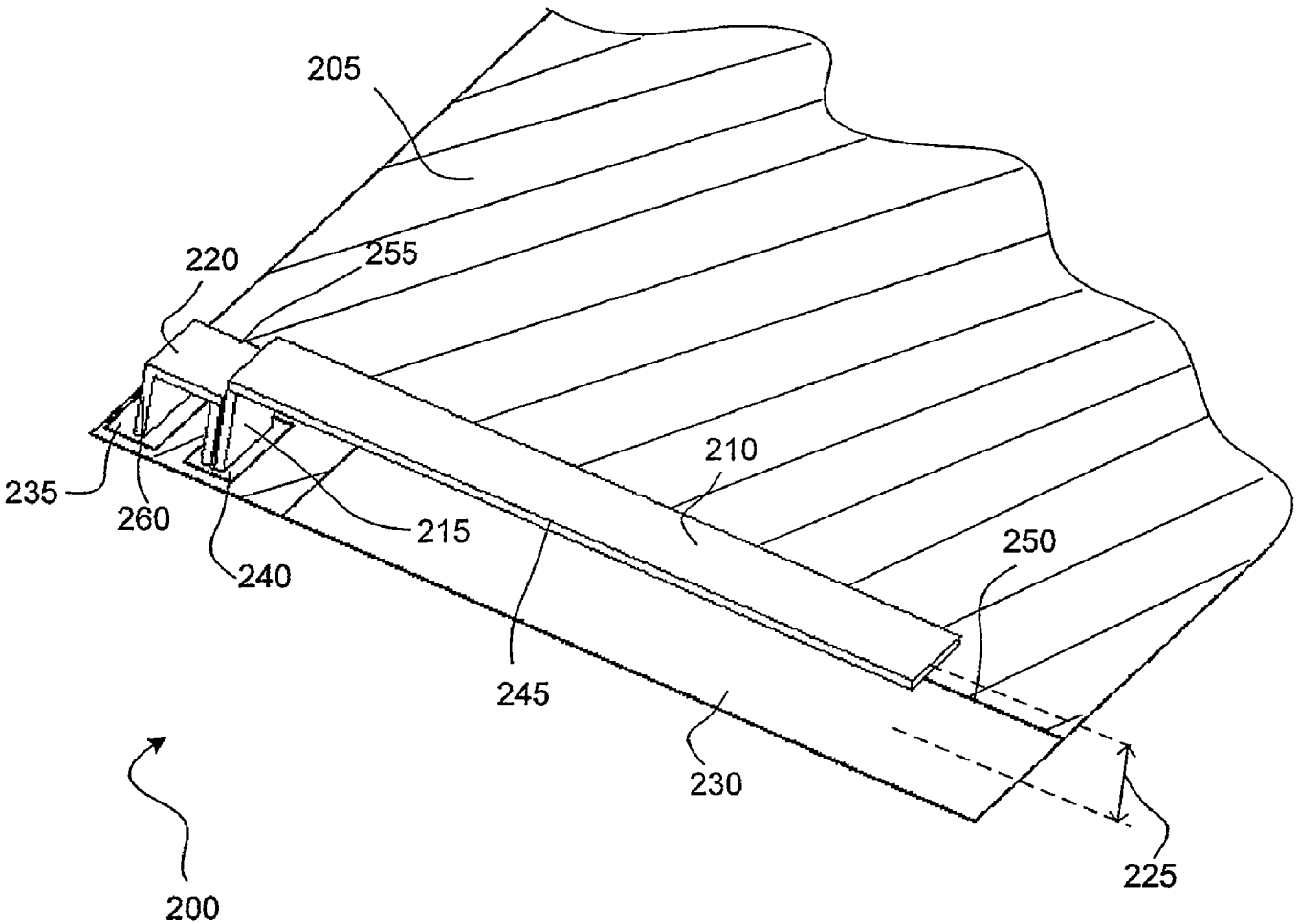
FIG. 2 illustrates, in isometric view, an exemplary embodiment of a PIFA according to an embodiment of the present invention.

FIG. 2 illustrates a PIFA 200 according to an embodiment of the present invention. PIFA 200 includes a ground plane 205 formed on a substrate 230, a radiating element 210, a feed element 215, and a tuning or shorting element 220. Tuning element 220 is coupled to a landing surface 235 that is electrically coupled to ground plane 205. In an embodiment, tuning element 220 is L-shaped with one of the legs coupled to surface 235 and the other leg coupled to feed element 215. In this way, PIFA 200 may be tuned simply by changing the height of the tuning element 220 without increasing the height of the overall PIFA profile. Specifically, the height or length of a leg portion 260 of tuning element 220 may be increased or decreased. By varying the height of tuning element 220, the current path length from surface 235 to surface 240 and to feed element 215 is varied. In this manner, the inductive characteristic of PIFA 200 is affected thus allowing PIFA 200 to be tuned.

In an alternative embodiment, tuning element 220 is U-shaped (or V-shaped), with one of the legs coupled to surface 235 and the other coupled to surface 240. Although L and U shapes are described, other shapes could also be used to increase the current path length as would be understood by one skilled in the art.

In PIFA 200, feed element 215 is coupled to a surface 240. Surface 240 is electrically isolated from ground plane 205. Although not shown, feed element 215 is coupled to a coaxial feed line underneath ground plane 205 and substrate 230. The coaxial feed line provides radio frequency (RF) signals to the feed element which in turns feeds RF signals to radiating element 210. In an alternative embodiment, feed element 215 is coupled to a microstrip line, embedded microstrip line, slotline, or coplanar line located on the same layer or a layer below of feed element 215.

Radiating element 210 is suspended above substrate 230 by feed element 215 at a certain distance 225. For example, in one embodiment, radiating element 210 is suspended in parallel with substrate 230. In general, the impedance bandwidth of PIFA 200 may be affected by varying distance 225. Up to a certain height threshold, an increase in distance 225 corresponds to an increase in the impedance bandwidth of PIFA 200. However, this technique is disadvantageous because it increases the overall antenna package size. Alternatively, PIFA 200 may be capacitively or dielectrically loaded. These techniques are also disadvantageous because they add complexity and cost to the PIFA. In PIFA 200, the impedance bandwidth is increased by suspending radiating element 210 such that an edge 245 of radiating element 210 extends pass an edge 250 of ground plane 205. In other words, ground plane 205 is retracted with respect to substrate 230 and/or radiating element 210. Further, from a different perspective, edge 245 falls outside of a perimeter image of ground plane 205, if such an image is projected onto the same horizontal plane of radiating element 210.

From yet another perspective, a portion of the perimeter of radiating element 210 overhangs edge 250 of ground plane 205 if such perimeter portion is projected onto ground plane 205 horizontal plane. Stated another way, a portion of radiating element 210 is above ground plane 205 and a portion is above substrate 230. In this way, PIFA 200 impedance bandwidth is increased because a portion of radiating element 205 is further away from ground plane 205 as compared to when radiating element 205 is fully inside of ground plane's 205 perimeter. In an alternative embodiment, the radiating element 210 is suspended such that substantially all of radiating element 210 falls outside of ground plane 205 perimeter's projection. In other words, radiating element 210 is not directly below or above ground plane 205. Additionally, ground plane 205 may be sandwiched between substrate 230 and a dielectric layer (not shown) formed on top of ground plane 205.

As illustrated in FIG. 2, PIFA 200 may be tuned simply by replacing tuning element 220 with a smaller or larger tuning element. For example, the length of leg portions 255 and 260 of tuning element 220 may be increased to affect the current path. In this way, the positional change of feed element 215 is simulated without having to actually reposition feed element 215 and surface 240 with respect to tuning element 220. Even though tuning element 220 is shown to have a "L" shape, other shapes could also be used to increase the current path as would be understood by one skilled in the art.

Figure 3A:
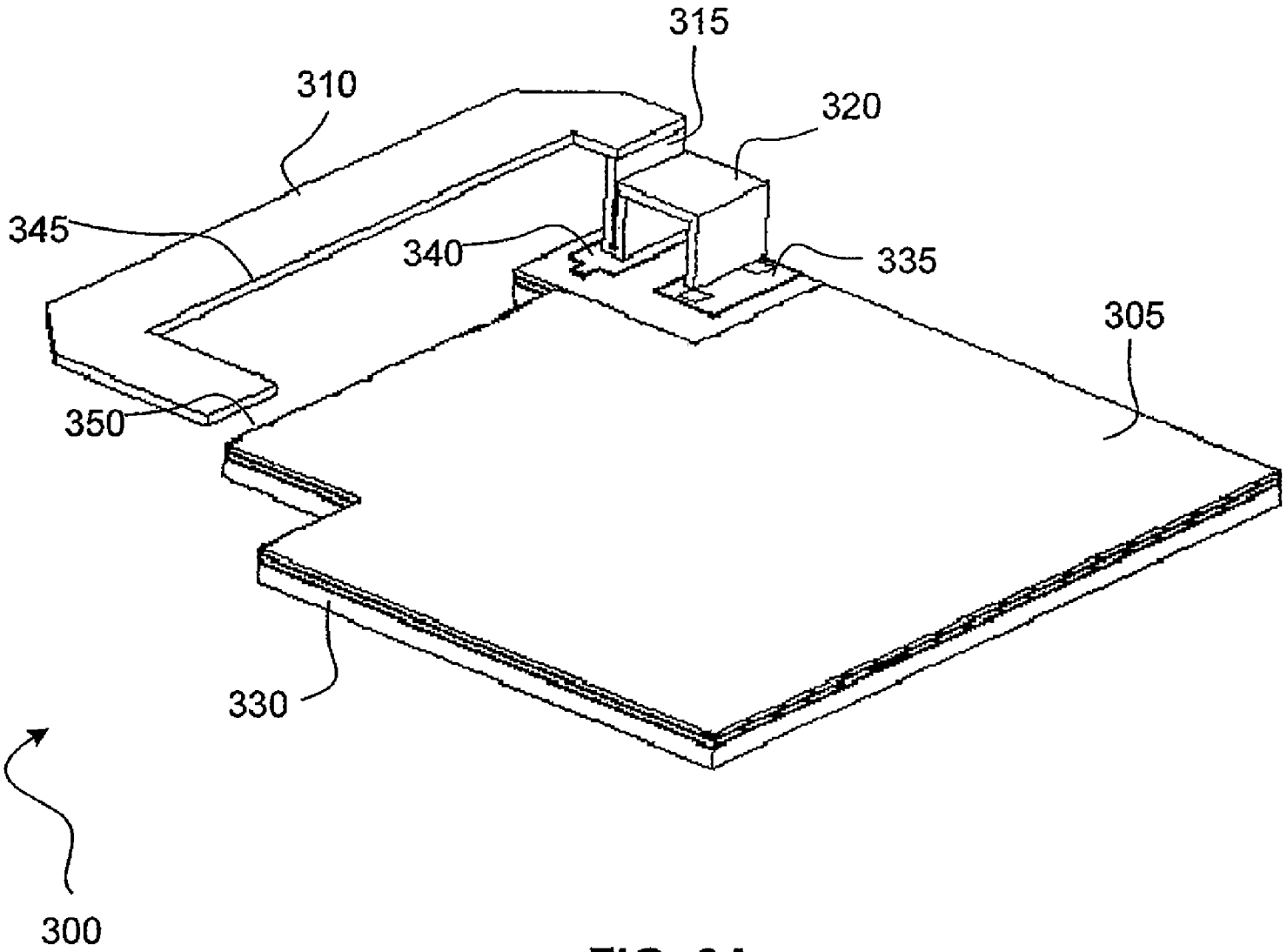
FIG. 3A illustrates, in isometric view, another exemplary embodiment of a PIFA according to an embodiment of the present invention.

FIG. 3A, illustrates a PIFA 300 according to an embodiment of the present invention. PIFA 300 includes a retracted ground plane 305 and a retracted substrate 330 that corresponds to ground plane 305. Ground plane 305 and substrate 330 are horizontally retracted with respect to radiating element 310. In this way, an edge or portion 345 of radiating element 310 is not directly above a surface of ground plane 305, and also is not above substrate 330. In PIFA 300, radiating element 310 is C-shaped. In this configuration, PIFA 300 may be made smaller while radiating element 310 still has a sizeable surface area. Further, retracted ground plane 305 and substrate 330 have a boundary line 350 that tracks along the general shape of radiating element 310 along boundary line 350. Further, PIFA 300 impedance bandwidth is increased because radiating element 310 tracks boundary line or edge 350.

Figure 3B:
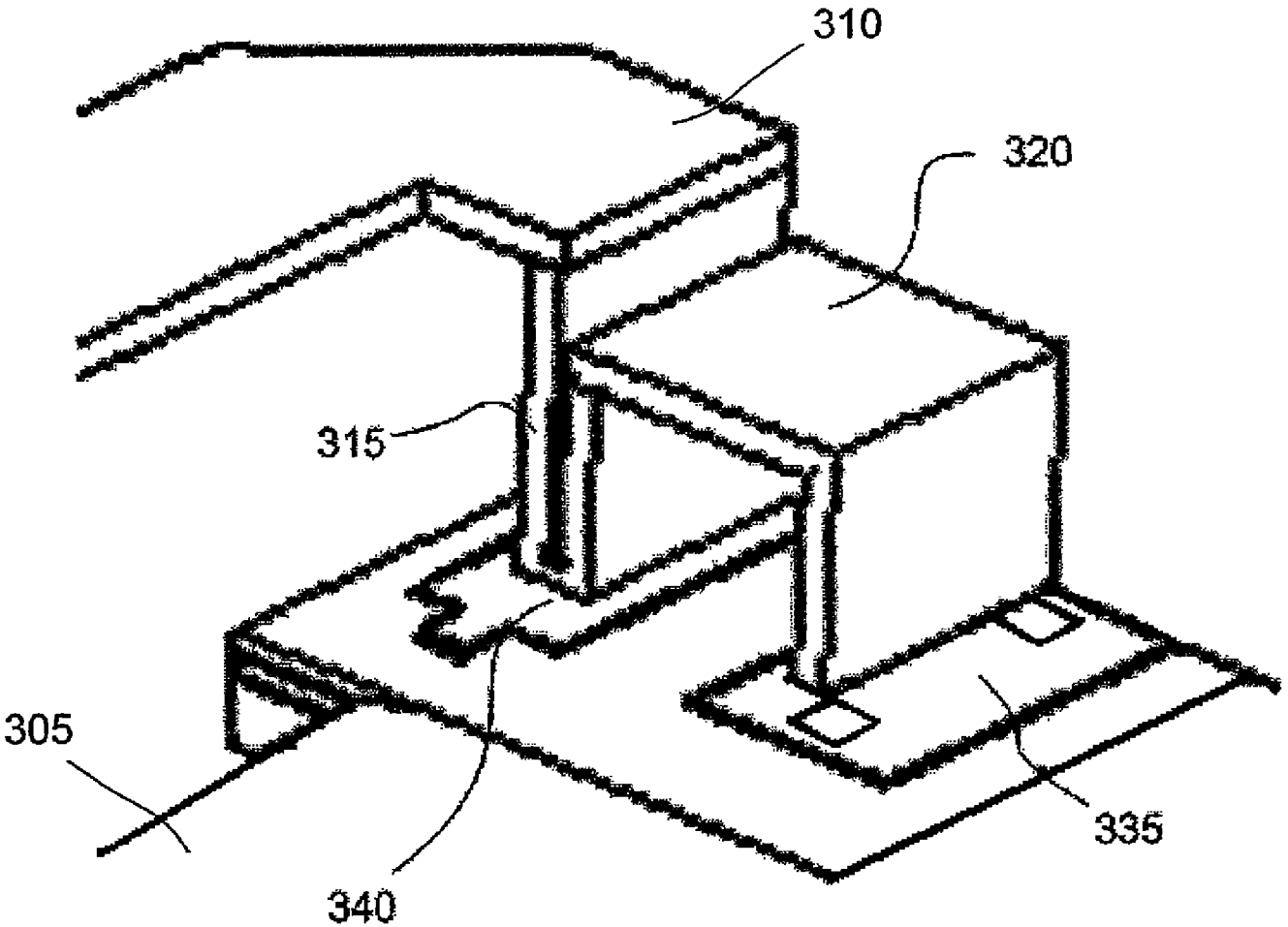
FIG. 3B illustrates a magnified view of a portion of the PIFA shown in FIG. 3A.

As shown in FIG. 3B, feed element 315 in PIFA 300 is shaped like the letter "U". More specifically, feed element 315 shapes like an unbalanced "U". The bottom feed element 315 is coupled to surface 340 and to a coaxial feed line (not shown). The longer leg of feed element 315 is coupled to radiating element 315. The shorter leg of feed element 315 is coupled to tuning element 320. This leg portion is adjusted in height according to the height of tuning element 320. In this configuration, PIFA 300 may be tuned simply by changing the shape and size of feed element 315 and tuning element 320 without having to move surfaces 335 and 340, and also without effecting radiating element's 310 height with respect to ground plane 305.

Figure 4:
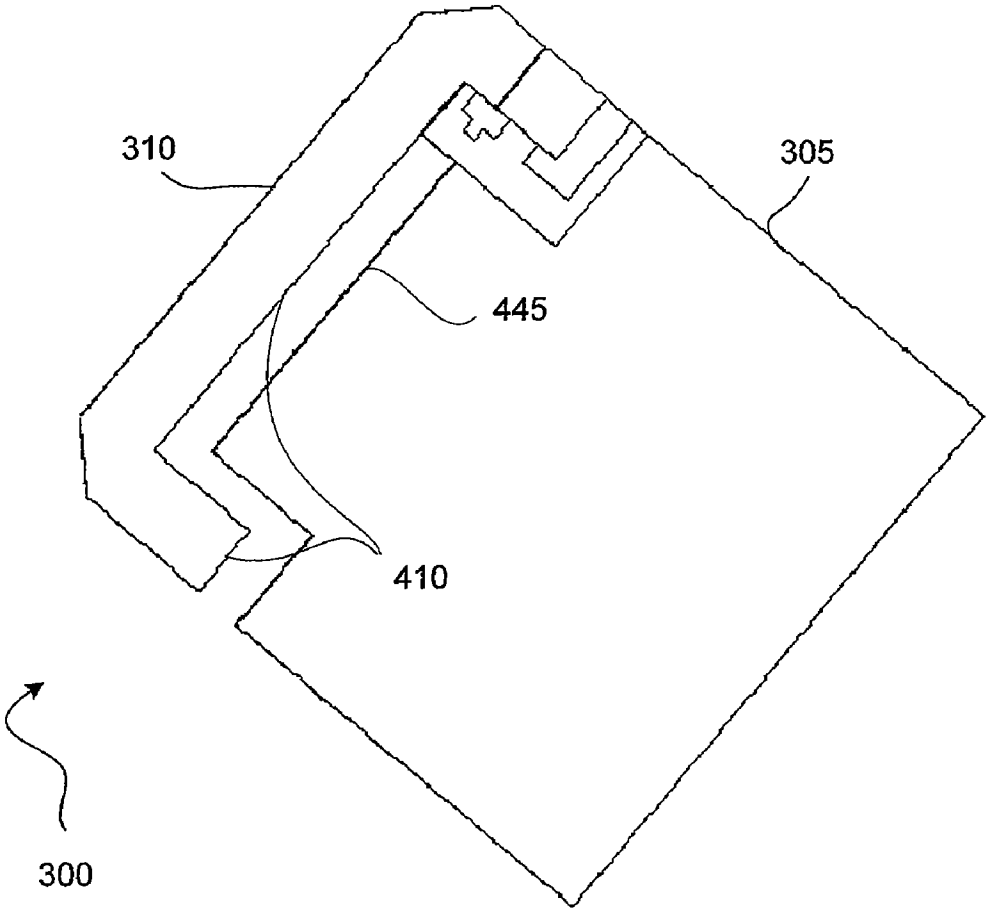
FIG. 4 illustrates a top view of the PIFA in FIG. 3A.

FIG. 4 illustrates a top view of PIFA 300 that includes radiating element 310 having a perimeter border line 410, and ground plane 305 having a corresponding perimeter border line 445. As shown in FIG. 4, border line 410 does not overlap border line 445 and is completely outside of ground plane's 305 perimeter. In an alternative embodiment, from the top view perspective, radiating element 310 is partially located directly above ground plane 305 such that border line 410 can be seen inside of ground plane 305. Even though radiating element 310 is being described and shown as having a C-shaped configuration, other shapes could also be used to affect the PIFA resonance frequency as would be understood by one skilled in the art.

Figure 5:
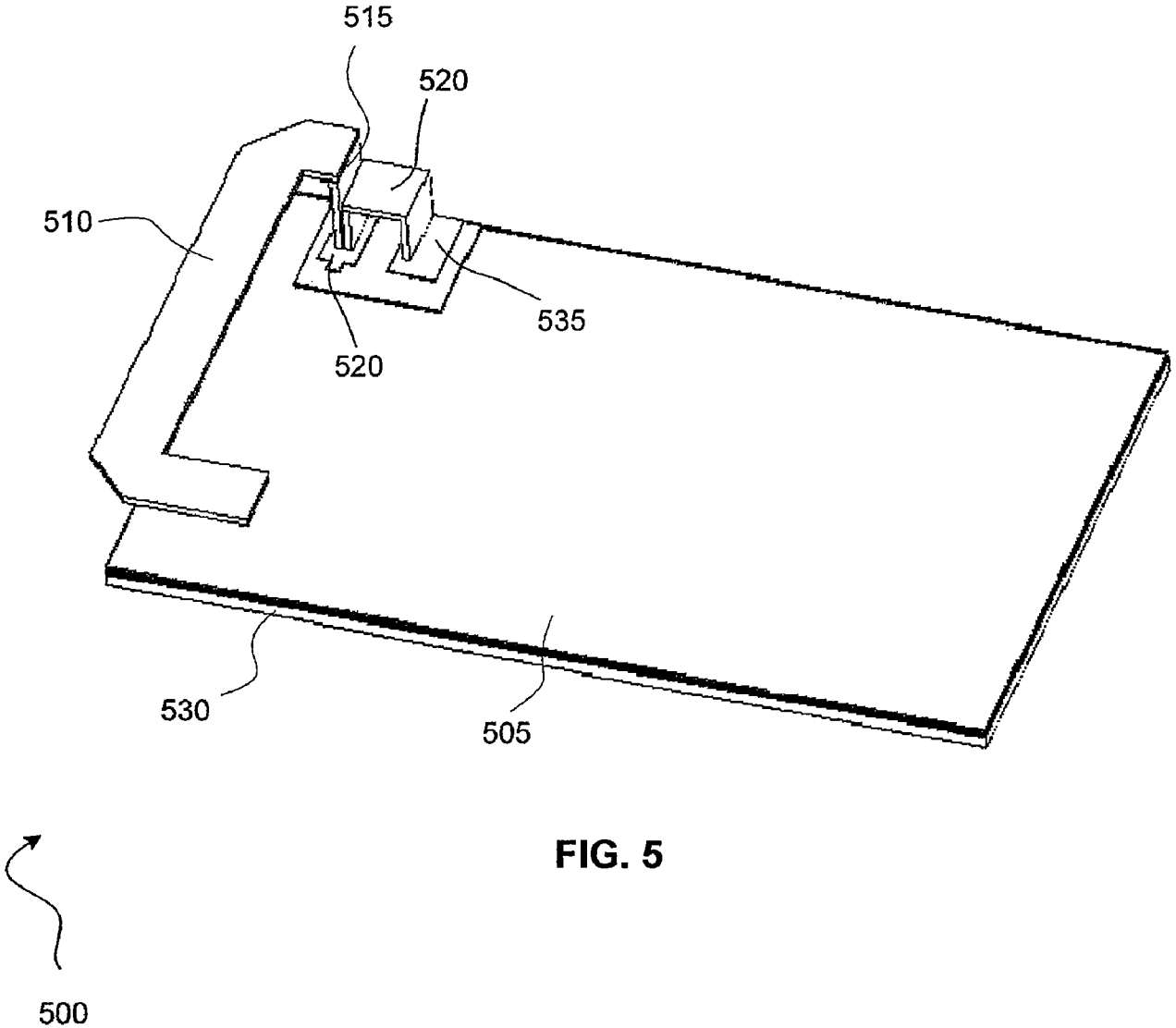
FIG. 5 illustrates, in isometric view, an exemplary embodiment of a PIFA according to an embodiment of the present invention.
Figure 6:
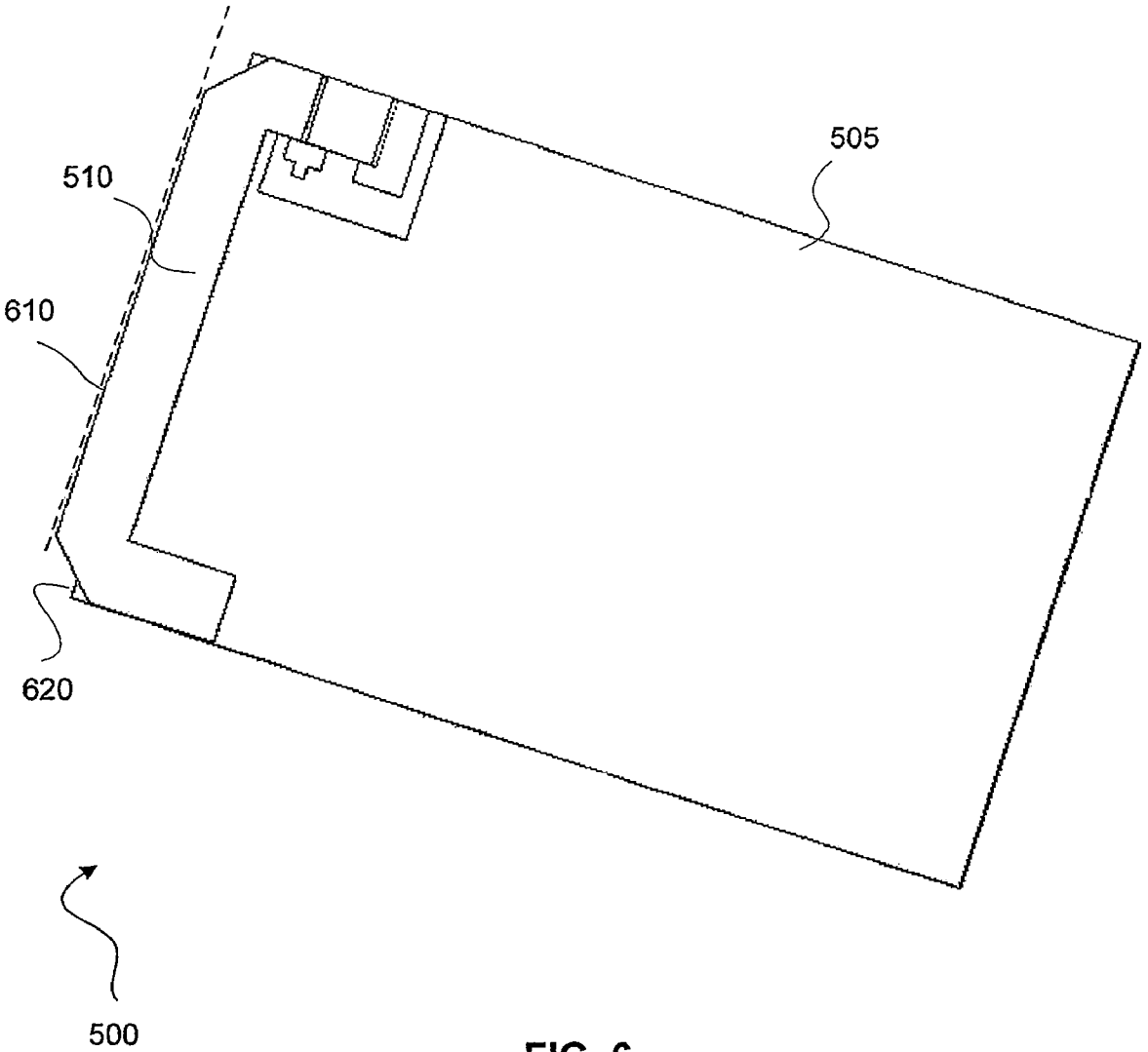
FIG. 6 illustrates a top view of the PIFA in FIG. 5.

FIG. 5 illustrates a PIFA 500 according to another embodiment of the present invention. PIFA 500 may include all of the features of PIFA 200. As shown, PIFA 500 includes a rectangular ground plane 505, a radiating element 510, and a rectangular substrate 530. In PIFA 500, ground plane 505 and substrate 530 are flushed with one another at the perimeter. As illustrated in FIG. 6, a top view of PIFA 500, radiating element 510 partially overhangs ground plane 505. In this configuration, a edge 610 of radiating 510 is located, from a horizontal perspective, beyond a edge 620 of ground plane 605. In this way, PIFA 500 can have an increased impedance bandwidth without having to increase the vertical height of the overall antenna package.

Figure 7:
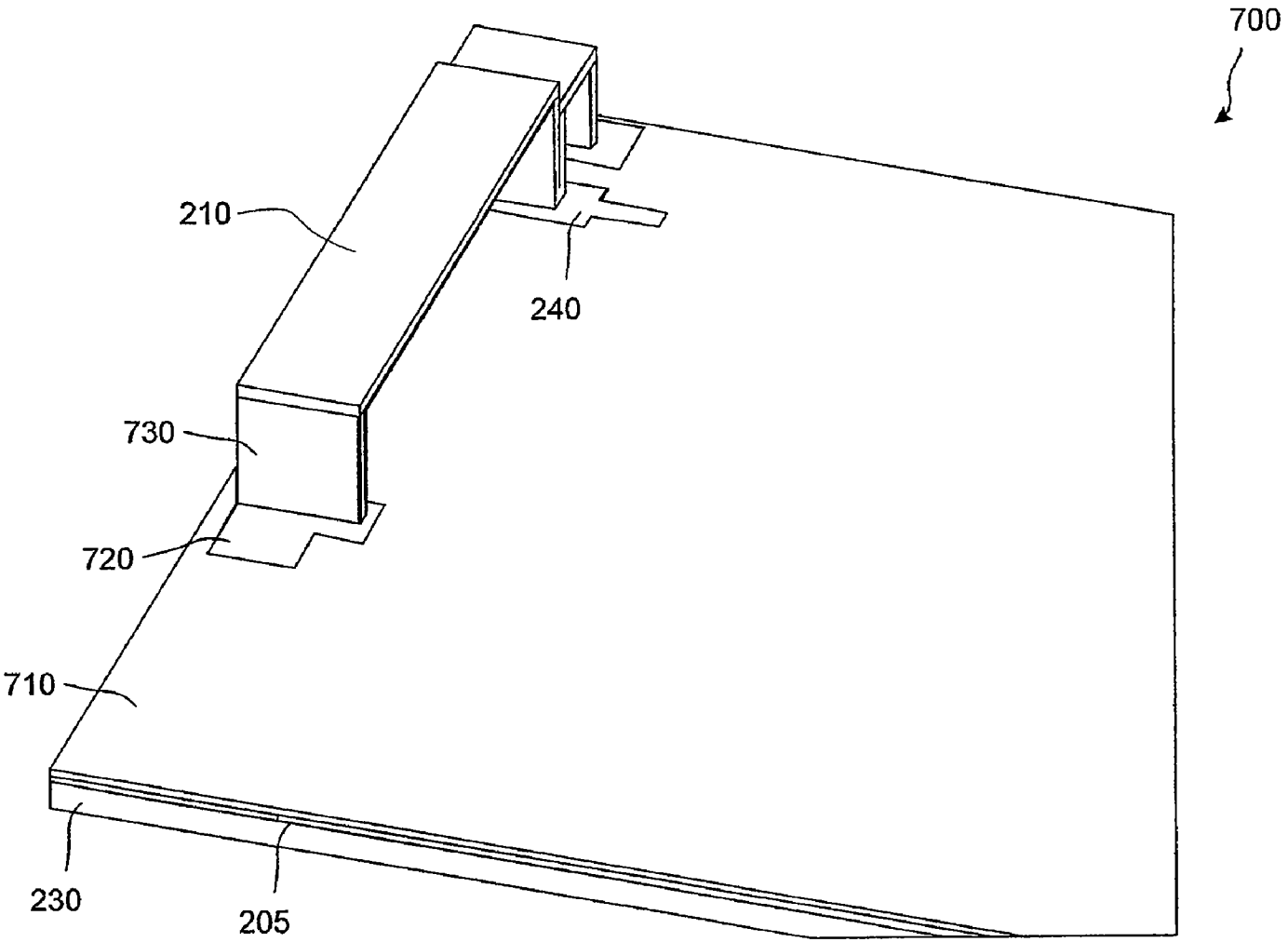
FIG. 7 illustrates, in isometric view, another exemplary embodiment of a PIFA according to an embodiment of the present invention.

FIG. 7 illustrates a PIFA 700 according to another embodiment of the present invention. PIFA 700 is similar to PIFA 200. PIFA 700 may include some or all of the features of PIFA 200. As illustrated in FIG. 7, PIFA 700 includes a top dielectric layer 710, a support pad 720, and a support structure 730. Dielectric layer 710 is formed on top of ground plane 205. In this way, ground plane 205 is sandwiched between dielectric layer 710 and substrate 230. Dielectric layer 710 provides a couple of functions. One of the functions is to isolate feed pad or surface 240 and support pad 720 from ground plane 205, the other function is to provide a support surface.

As eluded to above, support pad 720 is anchored to dielectric layer 710. Although not shown, no portion of ground plane 205 is located beneath support pad 720. In this way, current traveling through radiating element 210 and support structure 730 remains isolated from ground plane 205. In an embodiment, support pad 720 has a rectangular shape. In an alternative embodiment, support pad 720 has a regular polygonal or an irregular polygonal shape as shown in FIG. 7. The shape and size of support pad 720 is primarily determined by the tuning requirements of PIFA 700, which will be discussed below.

Support structure 730 provides additional support for radiating element 210. In PIFA 200, radiating element 210 is cantilevered from support structure 215. Considering the size and scale of PIFA 200, the length of radiating element 210 is very short. Thus structural integrity is not an issue. However, through handling and packaging of the PIFA 200, radiating element 210 may be accidentally bent for example. Support structure 730 allows PIFA 700 to be more versatile. Thus accidental bending or other physical deformation will less likely occur during manufacturing and/or packaging process. Another added benefit of support structure 730 is the increased current path length. The additional current path length may help to reduce the overall height of radiating element 210 by allowing feed element 215 to be shorter, while keeping the total current path length the same.

As previously discussed, PIFA 200 may be tuned by changing the length or height of leg portion 260 of tuning element 220. By varying the height of tuning element 220, the overall current path length from surface 235 to surface 240 and to feed element 215 is varied. In this manner, the inductive characteristic of PIFA 200 is affected thus allowing PIFA 200 to be tuned. Similarly, the inductive characteristic of PIFA 700 may also be varied by changing the height of support structure 730.

In an embodiment, the inductive characteristic of PIFA 700 may be varied by changing the shape and/or size of support pad 720. In this way, PIFA 700 may be tuned simply by extending a side of support pad 720. For example, as shown in FIG. 7, a portion of a side of support pad 720 is extended. This extension serves as an extension to radiation element 210 and/or support structure 730. In this way, the overall current path length of PIFA 700 is changed, thus allowing PIFA 700 to be properly tuned to any desired frequency band. In an alternative embodiment, instead of extending a portion of a side of support 720, the full length of the side is extended. Support structure 730 can be made with any conducting material. Preferably, support structure 730 and radiating element 210 comprises the same material such as a wire element or metal traces. Support pad 720 may also be made from the same material as radiating element 210 and/or support structure 730.

Figure 8:
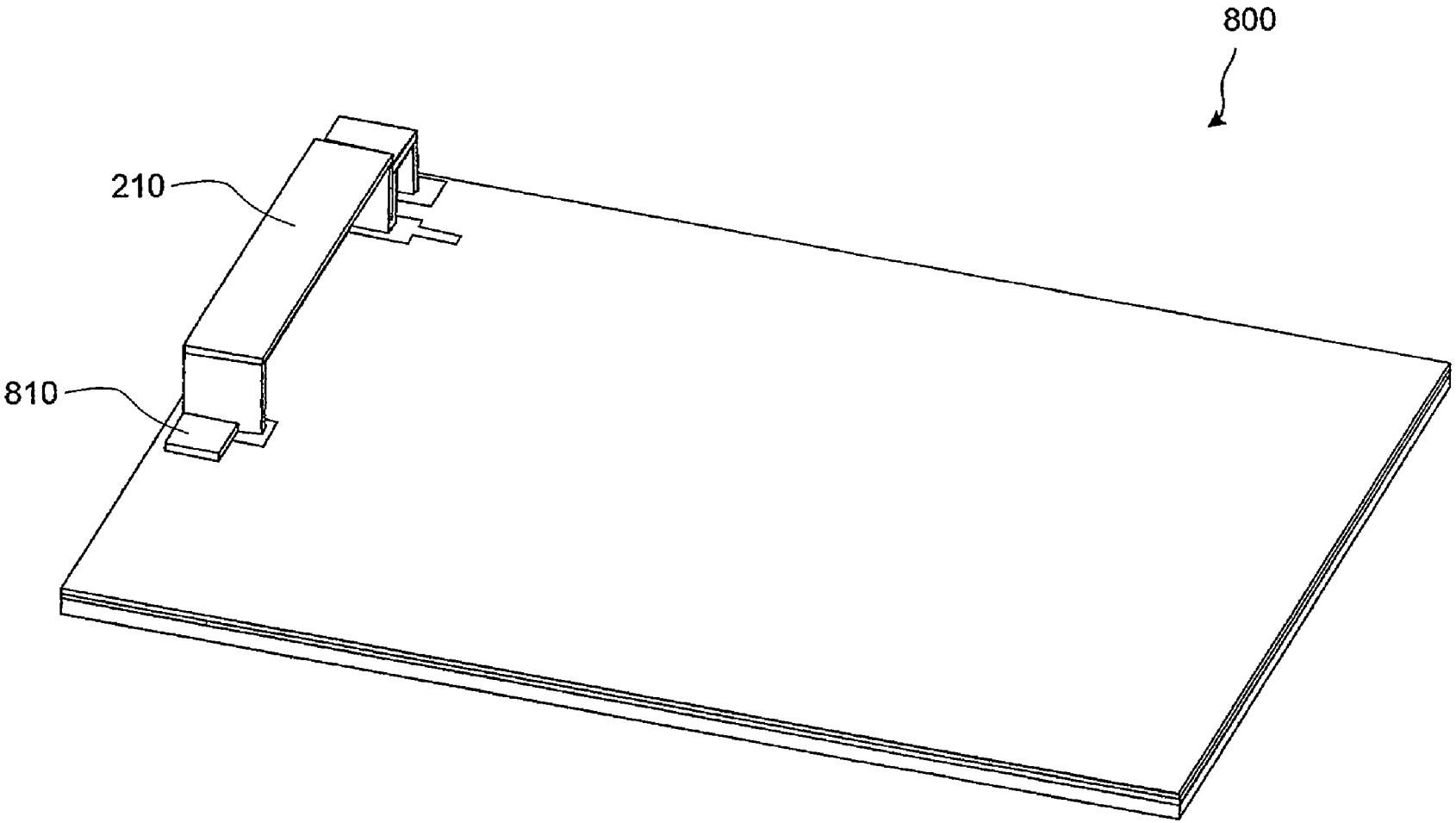
FIG. 8 illustrates yet another embodiment of a PIFA according to an embodiment of the present invention.

FIG. 8 illustrates a PIFA 800 according to another embodiment of the present invention. PIFA 800 is similar to PIFA 700 but also includes an extension (toe) 810 to support structure 730. In general, extension or toe 810 extends in the direction radiating element 210. In other words, if radiating element 210 has a semi-circular shape, then extension 810 will also take the form of an arc to add on to the semi-circular shape of radiating element 210. As shown in FIG. 8, radiating element 210 has a rectangular shape. Thus, extension 810 is also a rectangular structure that adds onto the length of radiating element 210 and support structure 730. Extension 810 may also have other shapes (i.e., shape substantially different than radiating element 210), as long as the overall current path length is changed. In this way, PIFA 800 may be tuned to any desired frequency band.

Figure 9:
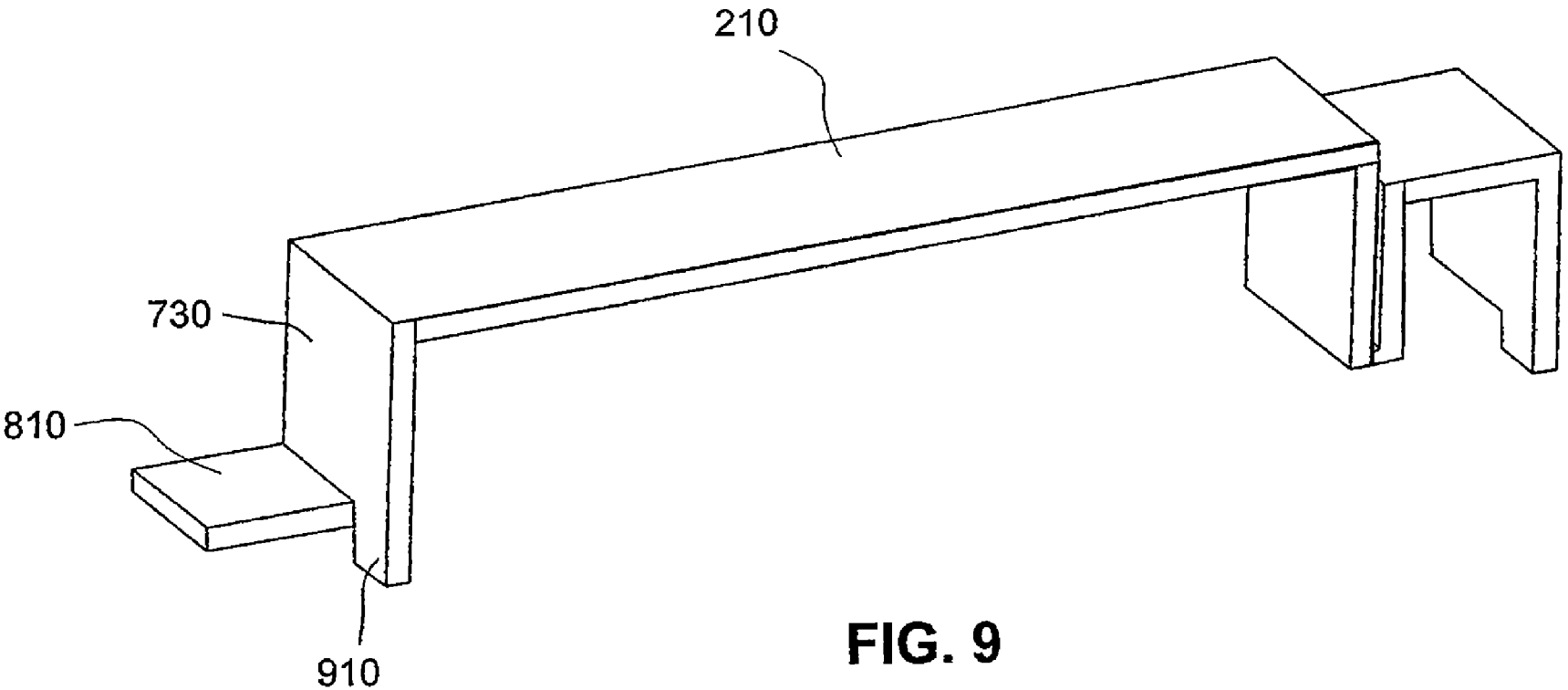
FIG. 9 illustrates a detailed view of an antenna portion of the PIFA illustrated in FIG. 8.

FIG. 9 illustrates a detailed view of support structure 730 and extension 810. As shown, support structure 730 includes an extended portion 910 that is used to anchor support structure onto substrate layer 230 below. This is accomplished by threading portion 910 through a via in dielectric layer 710 and support pad 720.

CONCLUSION

While various embodiments of the present invention have been described above, it should be understood that they have been presented by way of example only, and not limitation. It will be apparent to persons skilled in the relevant art that various changes in form and detail can be made therein without departing from the spirit and scope of the invention. Thus, the breadth and scope of the present invention should not be limited by any of the above-described exemplary embodiments, but should be defined only in accordance with the following claims and their equivalents.

We claim:

1. A Planar Inverted F-Antenna (PIFA) comprising:

a ground plane electrically coupled to a first pad;

a feed element electrically coupled to a second pad;

a radiating element coupled to the feed element, the radiating element being suspended above and substantially parallel to the ground plane such that at least a portion of a peripheral rim of the radiating element extends beyond an edge of the ground plane; and a tuning element electrically coupled between the first pad and the second pad, wherein the tuning element is shaped such that the tuning element protrudes beyond the ground plane from the first pad and loops back toward the ground plane to the second pad.

2. The PIFA of claim 1, wherein more than 50% of the peripheral rim extends beyond the edge of the ground plane, whereby the peripheral rim foam a plane parallel to the ground plane.

3. The PIFA of claim 1, wherein the radiating element is C-shaped.

4. The PIFA of claim 1, further comprising:

the first pad electrically coupling the tuning element to the ground plane; and the second pad being electrically isolated from the ground plane.

5. The PIFA of claim 4, wherein the tuning element is coupled to the feed element at the second pad and comprises a L-shape.

6. The PIFA of claim 1, wherein the feed element comprises a U or V shape.

7. The PIFA of claim 1, further comprising:

a dielectric layer located between first and second pads and the ground plane, a third pad on the surface of the dielectric layer; and a support structure on the third pad configured to provide support to the radiating element at an end opposite to the feed element.

8. The PIFA of claim 7, further comprising:

an extra support portion attached to a side of the support pad, wherein the extra support portion's size and/or shape is configured to tune the PIFA to a desired frequency band.

9. The PIFA of claim 7, further comprising:

a radiating portion attached to a side of the support structure, wherein the radiating portion is substantially parallel to the dielectric layer, and wherein the radiating portion's shape and/or size is configured to tune the PIFA to a desired frequency band.

10. A Planar Inverted F-Antenna comprising:

a ground plane electrically coupled to a first pad;

a feed element electrically coupled to a second pad;

a dielectric layer located between the first and second pads and the ground plane;

a radiating element having a surface substantially parallel to the ground plane, the radiating element being suspended from the ground plane by the feed element such that at least a portion of the surface extends beyond a perimeter of the ground plane; and a tuning element electrically coupled to the ground plane at the first pad and electrically coupled to the feed element at the second pad, wherein the tuning element is shaped such that the tuning element protrudes beyond the ground plane from the first pad and loops back toward the ground plane to the second pad.

11. The PIFA of claim 10, wherein more than 50% of the surface extends beyond the perimeter of the ground plane.

12. The PIFA of claim 10, wherein the radiating element is C-shaped.

13. The PIFA of claim 10, wherein:

the second pad being electrically isolated from the ground plane.

14. The PIFA of claim 10, wherein the tuning element comprises a L-shape.

15. The PIFA of claim 10, wherein the feed element comprises a U or V shape.

16. A Planar Inverted F-Antenna comprising:

a ground plane electrically coupled to a first pad;

a feed element electrically coupled to a second pad;

a dielectric layer located between the first and second pads and the ground plane;

a radiating element having a surface substantially parallel to the ground plane, the radiating element being suspended from the ground plane by the feed element such that at least a portion of the surface intersects with a projected image of the ground plane's perimeter; and a tuning element electrically coupled to the ground plane at the first pad and electrically coupled to the feed element at the second pad, wherein the tuning element is shaped such that the tuning element protrudes beyond the ground plane from the first pad and loops back toward the ground plane to the second pad.

17. The PIFA of claim 16, wherein more than 50% of the surface is located outside of the projected image-plane.

18. The PIFA of claim 16, wherein the radiating element is C-shaped.

19. The PIFA of claim 16, wherein:

the second pad is electrically isolated from the ground plane.

20. The PIFA of claim 16, wherein the tuning element comprises a L-shape.

21. A Planar Inverted F-Antenna comprising:

a ground plane having first and second pads, the first pad being coupled to the ground plane, the second pad being electrically isolated from the ground plane;

a feed element coupled to the second pad;

a radiating element being suspended from the ground plane by the feed element; and a tuning element coupled to the first and second pads, the tuning element is shaped such that it protrudes beyond the ground plane from the first pad and loops back toward the ground plane to the second pad.

22. The PIFA of claim 21, wherein the radiating element has a surface that is substantially parallel to the ground plane and being suspended from the ground plane by the feed element such that at least a portion of the surface intersects with a projected image of the ground plane's perimeter.

23. The PIFA of claim 21, wherein the radiating element has a surface that is substantially parallel to the ground plane and being suspended from the ground plane by the feed element such that all of the surface extends beyond a projected image of the ground plane's perimeter.

24. The PIFA of claim 21, wherein the feed element comprises a U or V shape.

* * * * *

UNITED STATES PATENT AND TRADEMARK OFFICE

CERTIFICATE OF CORRECTION

PATENT NO. : 7,969,361 B2
APPLICATION NO. : 11/679659
DATED : June 28, 2011
INVENTOR(S) : Castaneda et al.

It is certified that error appears in the above-identified patent and that said Letters Patent is hereby corrected as shown below:

In Column 6, line 66, replace “foam” with --forms--.

Signed and Sealed this
Thirty-first Day of January, 2012

David J. Kappos

David J. Kappos
*Director of the United States Patent and Trademark Office*